US010913088B2

(12) United States Patent
Fukada et al.

(10) Patent No.: US 10,913,088 B2
(45) Date of Patent: Feb. 9, 2021

(54) COATING NOZZLE HEAD, AND LIQUID-APPLYING APPARATUS INCLUDING THE SAME

(71) Applicant: Panasonic Intellectual Property Management Co., Ltd., Osaka (JP)

(72) Inventors: Kazuki Fukada, Osaka (JP); Tohru Nakagawa, Osaka (JP); Hidehiro Yoshida, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 65 days.

(21) Appl. No.: 16/041,123

(22) Filed: Jul. 20, 2018

(65) Prior Publication Data

US 2019/0047015 A1 Feb. 14, 2019

(30) Foreign Application Priority Data

Aug. 8, 2017 (JP) ..... 2017-153364
May 7, 2018 (JP) ..... 2018-088999

(51) Int. Cl.
*B05C 5/02* (2006.01)
*B05B 1/30* (2006.01)
(Continued)

(52) U.S. Cl.
CPC ..... *B05C 5/0291* (2013.01); *B05C 5/0225* (2013.01); *B05B 1/083* (2013.01); *B05B 1/3046* (2013.01); *B05C 11/1034* (2013.01)

(58) Field of Classification Search
CPC ..... B05B 1/083; B05B 1/3046; B05C 5/0291; B05C 5/0225; B05C 11/1034; Y10T 137/86847
(Continued)

(56) References Cited

U.S. PATENT DOCUMENTS 2,148,703 A * 2/1939 Martin ..... F16K 31/10 137/625.65
2,511,844 A * 6/1950 Grove ..... G05D 7/0106 251/58
(Continued)

FOREIGN PATENT DOCUMENTS

| | | |
|---|---|---|
| CN | 103717319 | 4/2014 |
| JP | 10-314640 | 12/1998 |
| JP | 2015-051399 | 3/2015 |

OTHER PUBLICATIONS

English Translation of Chinese Search Report dated Jun. 5, 2020 in Chinese Patent Application No. 201810822944.5.

*Primary Examiner* — Joseph A Greenlund
(74) *Attorney, Agent, or Firm* — Wenderoth, Lind & Ponack, L.L.P.

(57) ABSTRACT

A liquid-coating apparatus includes: (a) a nozzle hole from which a liquid material is to be discharged; (b) a supply flow channel configured to supply the liquid material to the nozzle hole; (c) a plunger configured to reciprocate in contact with the liquid material inside the supply flow channel; (d) a displacement-expansion mechanism configured to displace the plunger; and (e) an actuator configured to displace the displacement-expansion mechanism, wherein at least one of a contact part of the displacement-expansion mechanism and a contact part of the actuator has a curved surface.

7 Claims, 10 Drawing Sheets

(51) Int. Cl.
*B05C 11/10* (2006.01)
*B05B 1/08* (2006.01)

(58) Field of Classification Search
USPC ..... 239/101, 102.2, 89, 90; 251/243, 129.2; 137/625.44
See application file for complete search history.

(56) References Cited

U.S. PATENT DOCUMENTS 2,770,441 A * 11/1956 Grove ..... G05D 16/0694 251/58
4,022,166 A * 5/1977 Bart ..... F02M 47/02 239/584
4,170,440 A * 10/1979 Gusmer ..... B29B 7/603 417/426
4,285,497 A * 8/1981 Gottel ..... F16K 31/105 137/625.44
4,561,631 A * 12/1985 Slavin ..... F16K 31/0682 251/129.2
4,840,193 A * 6/1989 Schiel ..... F16K 31/10 137/596.17
5,139,226 A * 8/1992 Baldwin ..... F16K 31/0682 137/625.44
5,226,628 A * 7/1993 Daly ..... F02M 51/0603 239/585.2
5,271,226 A * 12/1993 Stone ..... F16K 31/007 239/102.2
6,032,832 A * 3/2000 Dority ..... B05C 5/0225 222/214
6,945,276 B2 * 9/2005 Dorfler ..... F16K 31/006 137/625.44
9,254,642 B2 * 2/2016 Ciardella ..... B41J 2/045
2002/0166542 A1 * 11/2002 Kirzhner ..... F02M 51/0603 123/498
2005/0236438 A1 * 10/2005 Chastine ..... B05C 5/0237 222/504
2008/0061080 A1 * 3/2008 Riney ..... B05C 5/0225 222/146.5
2014/0291358 A1 * 10/2014 Fliess ..... B05C 5/0225 222/504
2016/0193624 A1 7/2016 Ikushima
2018/0221910 A1 * 8/2018 Burzo ..... H05K 13/0469
2019/0022692 A1 * 1/2019 Ikushima ..... F04B 43/046
2019/0047015 A1 * 2/2019 Fukada ..... B05C 5/0225

* cited by examiner

COATING NOZZLE HEAD, AND LIQUID-APPLYING APPARATUS INCLUDING THE SAME

TECHNICAL FIELD

The technical field relates to coating nozzle heads, and liquid-applying apparatuses including the same. In particular, the technical field relates to coating nozzle heads that discharge high-viscosity liquids, and liquid-applying apparatuses including the same.

BACKGROUND

Apparatuses that discharge liquid materials based on reciprocating movement of plungers have been known.

For example, jet-type liquid-applying apparatuses disclosed in JP-A-10-314640 can be mentioned.

In recent years, high-speed coating operations have been demanded for the purposes of improving productivity.

In such types of liquid-applying apparatuses, there is a growing demand for further increasing the number of discharging times for a certain period of time.

Therefore, it is required that plungers of the liquid-applying apparatuses are reciprocated at high speed.

As power sources for reciprocating the plungers, actuators such as motors, air pump, and piezoelectric elements are frequently employed.

In particular, piezoelectric elements make it possible to reciprocate the plunger at high speed.

However, since the resulting displacements are small, piezoelectric elements are generally combined with displacement-expanding mechanisms to increase the displacements.

For example, a technology disclosed in JP-A-2015-051399 has been known.

SUMMARY

Hereinafter, an exemplary related art liquid-applying apparatus using a displacement-expanding mechanism and a piezoelectric element will be described with reference to FIGS. 1 to 4.

A front view of the liquid-applying apparatus is shown in FIG. 1.

A cross-section of a discharge part of the liquid-applying apparatus is shown in FIG. 2.

The liquid-applying apparatus 1 discharges a discharge droplet 65 through a nozzle hole 60.

The liquid-applying apparatus 1 includes: a supply flow channel 52 which communicates with the nozzle hole 60, and into which a liquid material is supplied; a plunger 12*a*, a tip of which reciprocates inside the supply flow channel 52; actuators 2 that reciprocates the plunger 12*a*; and a displacement-expanding mechanism 3*a*.

The actuators 2 are placed symmetrically, and the displacement-expanding mechanism 3*a*, to the bottom of which the plunger 12*a* is connected, is formed by elastically-deformable U-shaped members 5,6,7,8 and 9.

An upward movement of the plunger 12*a* will be described with reference to FIG. 3.

A downward movement of the plunger 12*a* will be described with reference to FIG. 4.

When the actuator 2 causes a force that cause both ends of the respective U-shaped members 5,6,7,8 and 9 to separate from each other, the plunger 12 is caused to move upward.

On the other hand, when actuator 2 causes a force that causes the both ends of the respective U-shaped members 5,6,7,8 and 9 to come close to each other, the plunger 12*a* is caused to move downward.

In order to cause apparatuses to discharge high-viscosity liquid materials, it is required that the plunger 12 is moved at high speed and at a larger displacement.

In the displacement-expanding mechanism 3*a*, the U-shaped members 5,6,7,8 and 9 are elastically deformed to cause the plunger 12*a* to reciprocate in the vertical direction.

In order to secure a required displacement, the rigidity of U-shaped members 8 and 9 needs to be lower.

Accordingly, the natural frequency would be lower, and therefore, there is a limit to the extent of improvements in a displacement response speed of the plunger 12.

Thus, although the displacement of the plunger 12*a* can be increased by increasing an expansion factor of the displacement-expanding mechanism 3*a* against the displacement of the actuator 2, it would be difficult to simultaneously realize high-speed operations.

An object of present disclosure is to provide displacement-expanding mechanisms that realize high-speed and stable control of coating of high-viscosity liquid materials, and coating nozzle heads including the same, and liquid-applying apparatuses including the same and to provide a solution to the above problem.

In order to achieve the above object, provided is a liquid-coating apparatus, including: (a) a nozzle hole from which a liquid material is discharged; (b) a supply flow channel that supplies the liquid material to the nozzle hole; (c) a plunger that reciprocates in contact with the liquid material inside the supply flow channel; (d) a displacement-expansion mechanism that displaces the plunger; and (e) an actuator that displaces the displacement-expansion mechanism, wherein at least either of contact parts of the displacement-expansion mechanism and the actuator has a curved surface.

Accordingly, for the purposes of production of various electronic devices, it becomes possible to realize high-speed and stable control of coating of high-viscosity liquid materials including functional particles, and also, it becomes possible to apply optimum amounts of the liquid materials onto target places at predetermined patterns.

DESCRIPTION OF EMBODIMENTS

Hereinafter, embodiments will be described with reference to the drawings.

The descriptions below are merely examples, and therefore, the invention is not limited thereto.

<Liquid-Applying Apparatus>

<Structure>

Figure 1:
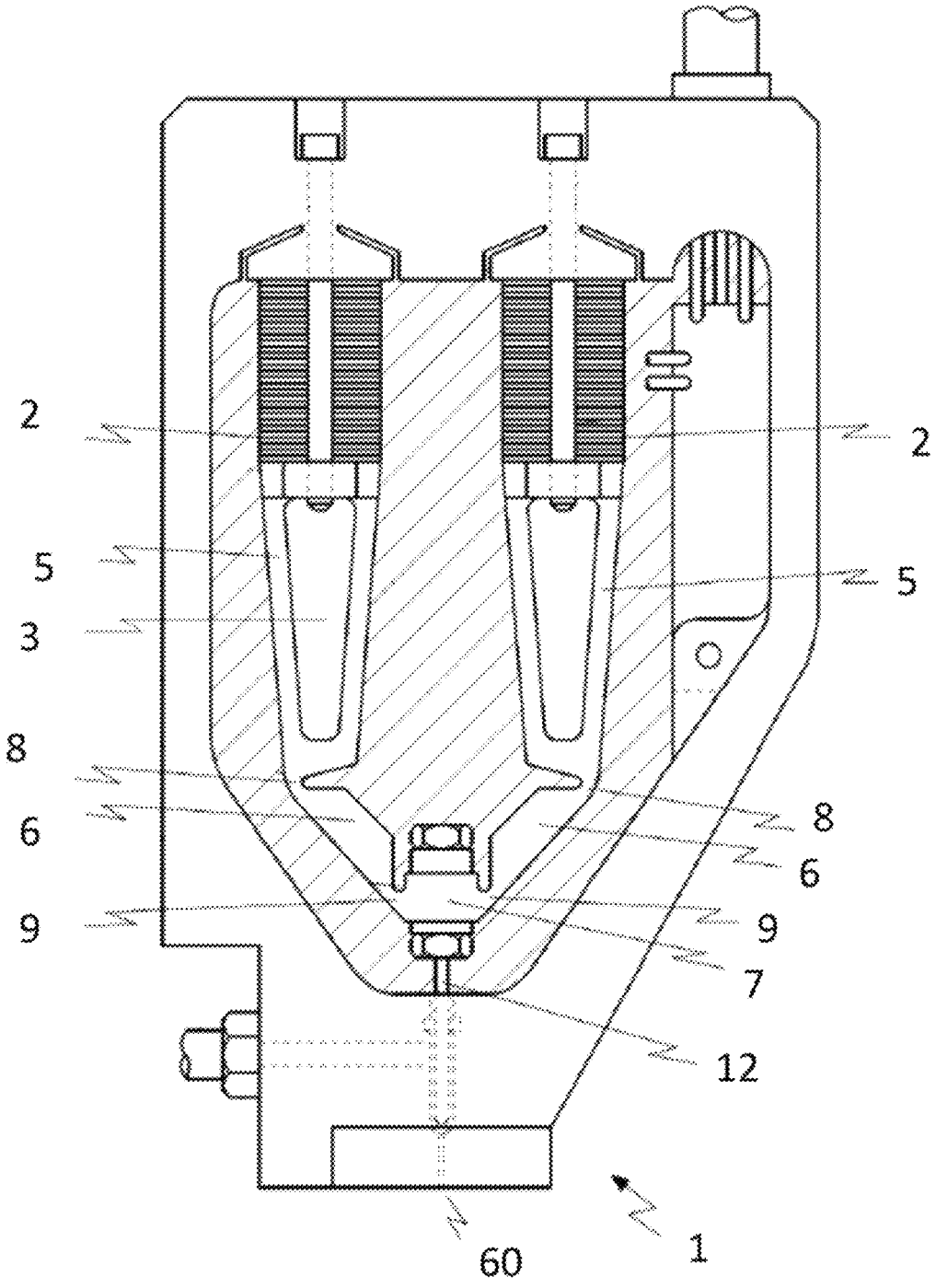
FIG. 1 RELATED ART
FIG. 1 is a front view of a related art liquid-applying apparatus.
Figure 2:
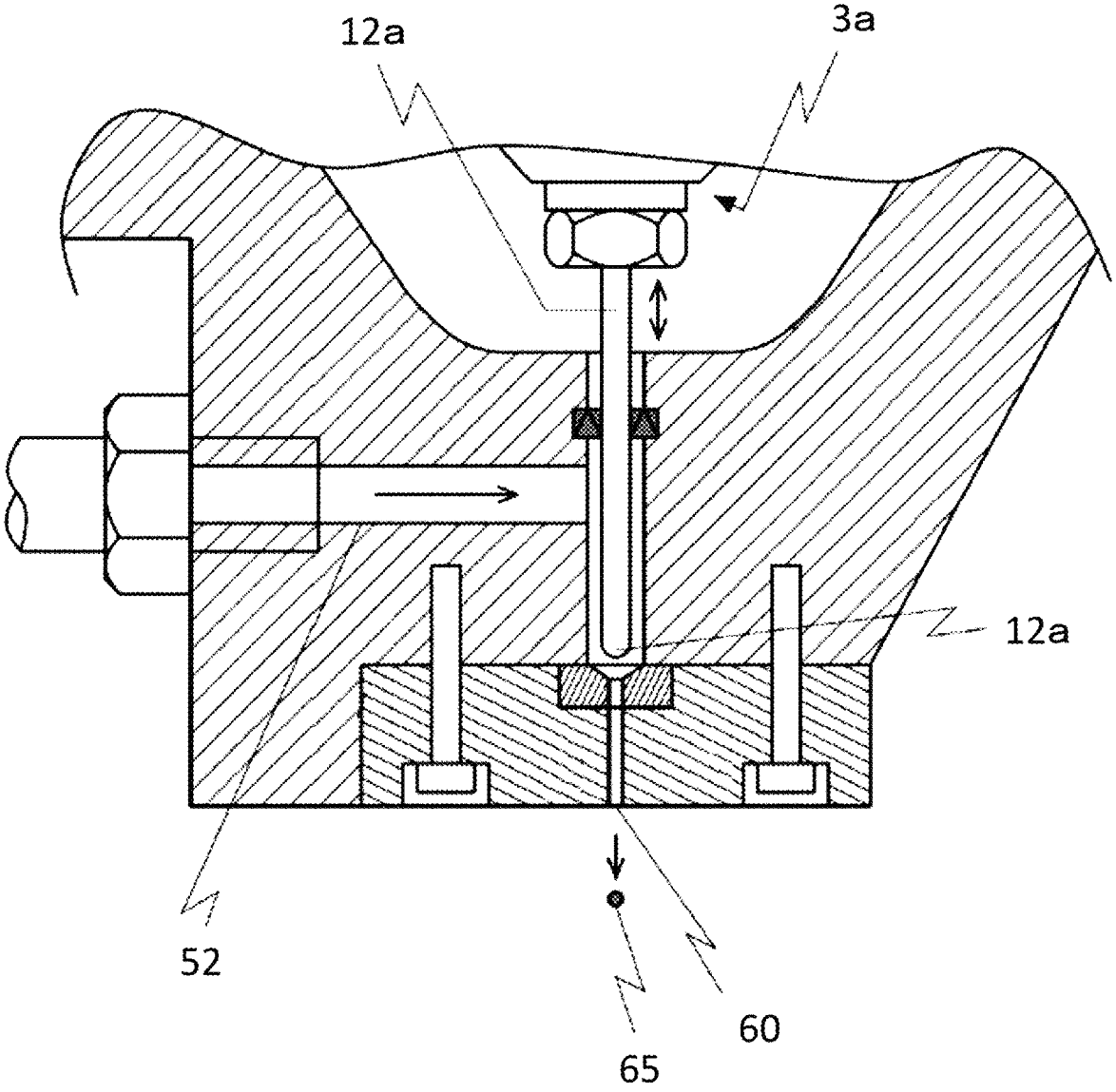
FIG. 2 RELATED ART
FIG. 2 is a cross-section view of the discharging part of the related art liquid-applying apparatus.
Figure 3:
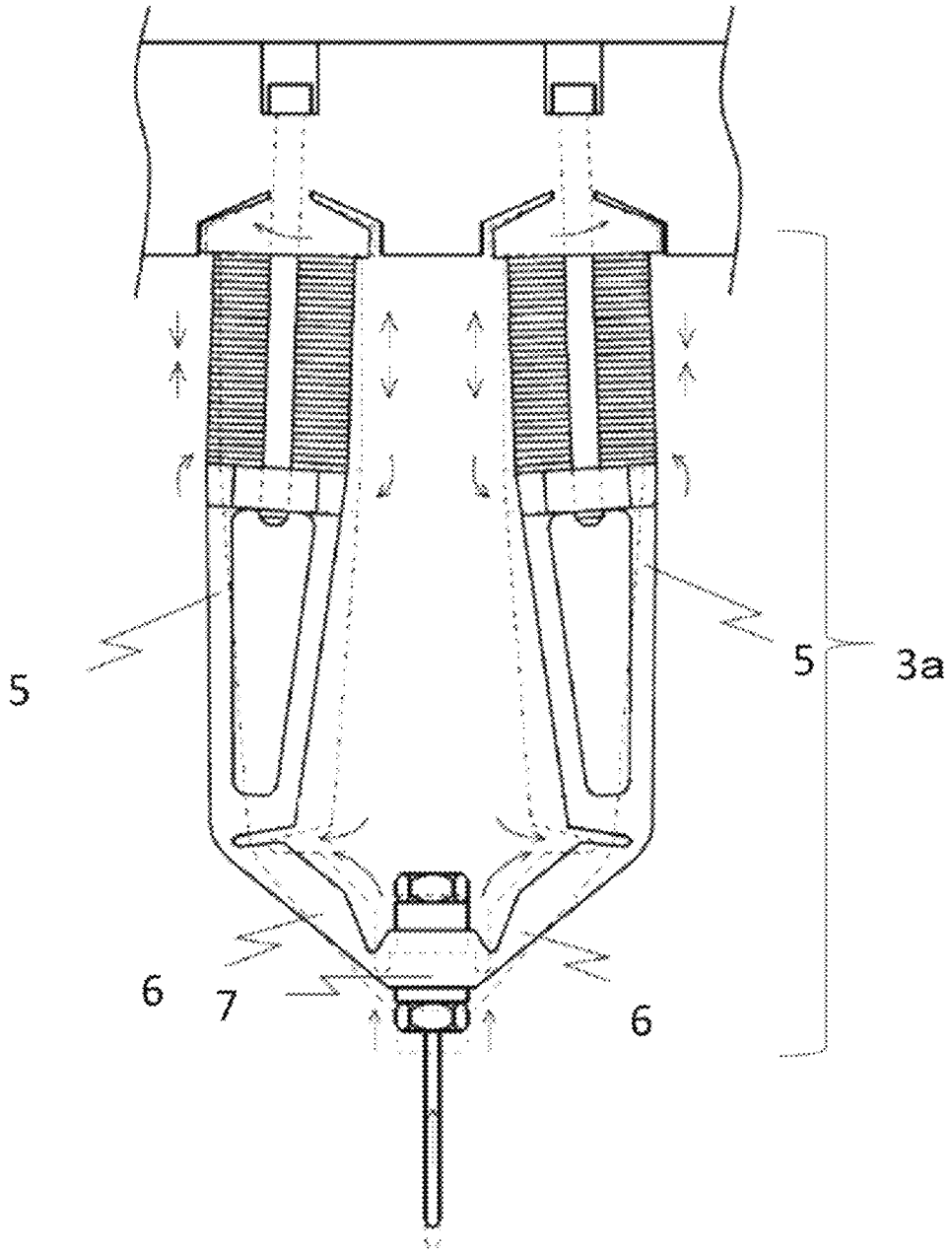
FIG. 3 RELATED ART
FIG. 3 is a diagram that illustrates an upward movement of the plunger in the related art liquid-applying apparatus.
Figure 4:
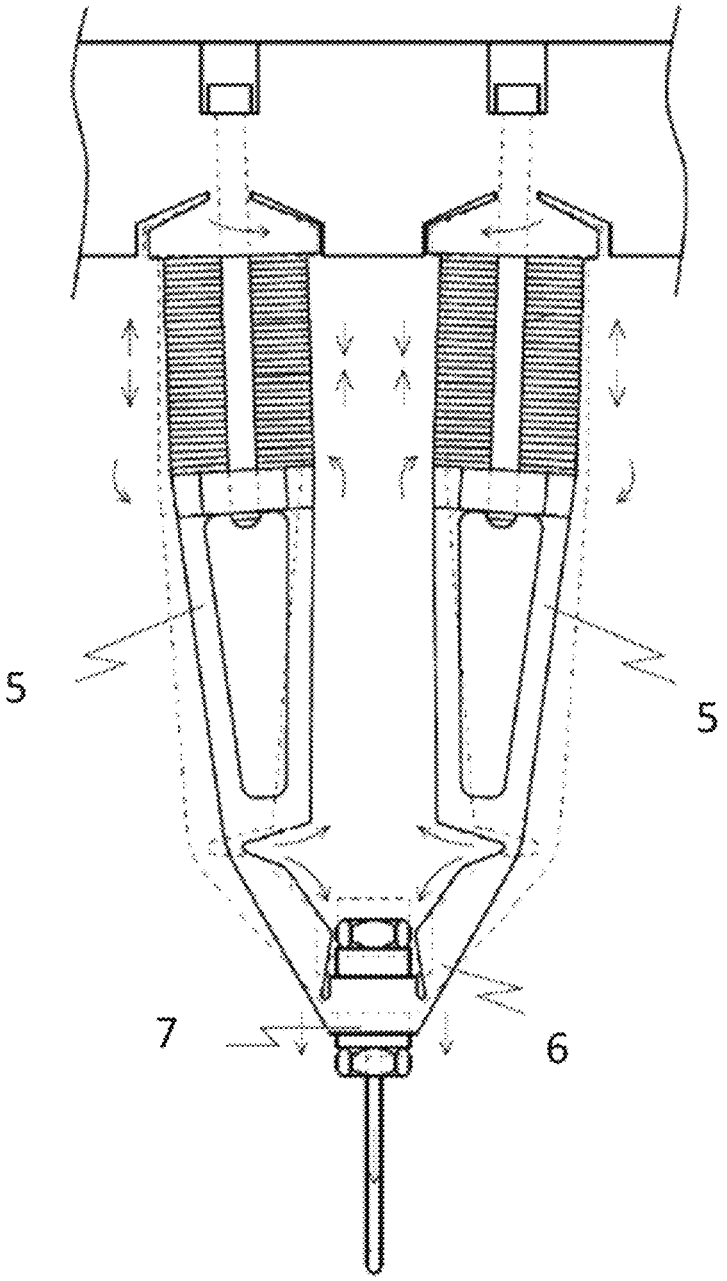
FIG. 4 RELATED ART
FIG. 4 is a diagram that illustrate a downward movement of the plunger in the related art liquid-applying apparatus.
Figure 5:
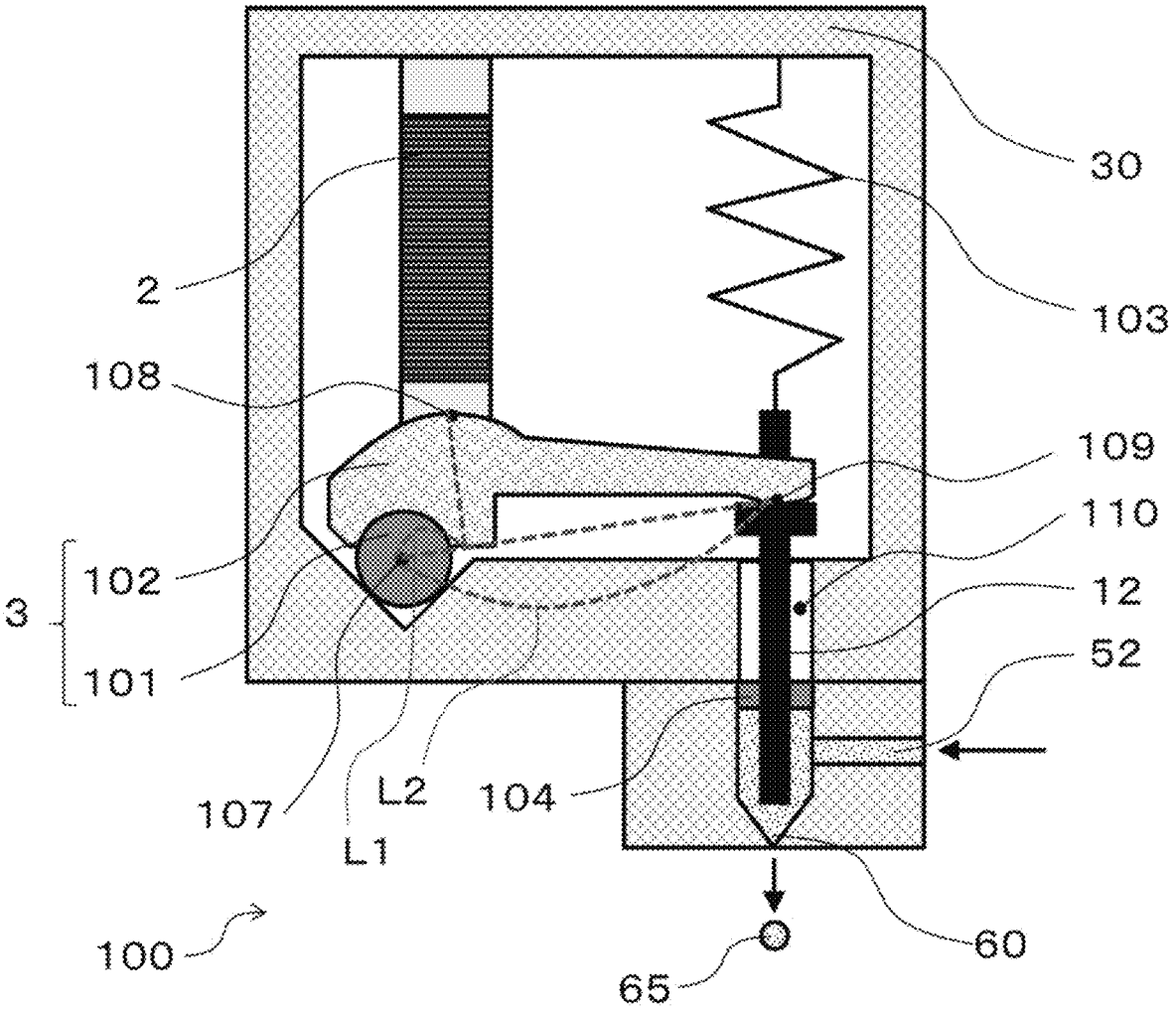
FIG. 5 is a cross-section view of a liquid-applying apparatus according to an embodiment.
Figure 6A:
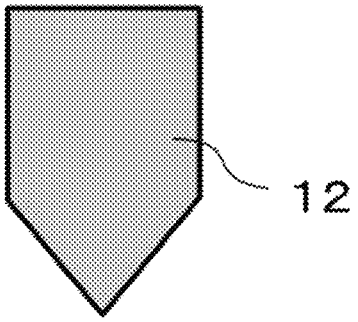
FIG. 6A is a cross-section of a tip of a plunger in an embodiment.
Figure 6B:
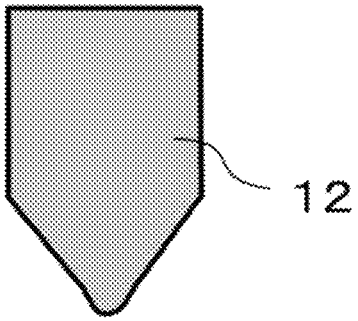
FIG. 6B is a cross-section of a tip of a plunger in an embodiment.
Figure 6C:
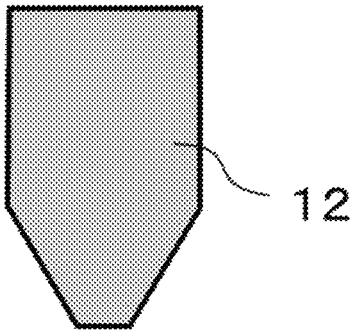
FIG. 6C is a cross-section of a tip of a plunger in an embodiment.
Figure 6D:
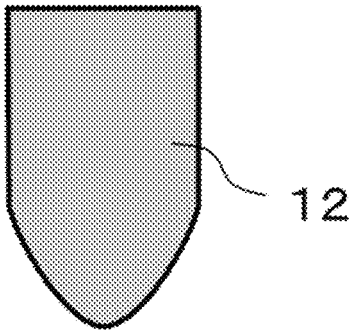
FIG. 6D is a cross-section of a tip of a plunger in an embodiment.
Figure 6E:
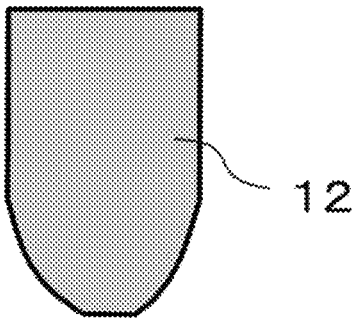
FIG. 6E is a cross-section of a tip of a plunger in an embodiment.
Figure 6F:
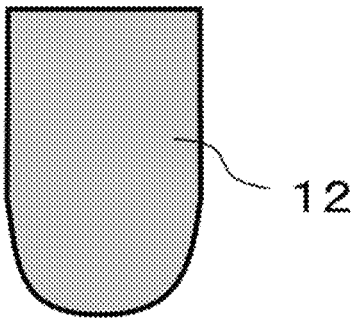
FIG. 6F is a cross-section of a tip of a plunger in an embodiment.

FIG. 5 is a cross-section view of a liquid-applying apparatus 100 according to an embodiment, and a basic structure thereof will be described below.

The liquid-applying apparatus 100 discharges a discharge droplet 65 of a liquid material, from a nozzle hole 60.

The liquid-applying apparatus 100 includes: a supply flow channel 52 that communicates with the nozzle hole 60 and that the liquid material is supplied into; a plunger 12, a tip of which reciprocates inside the supply flow channel; an actuator 2 that causes the plunger 12 to reciprocate; and a displacement-expanding mechanism 3.

Features of each of the elements will be described below.

<Nozzle Hole 60>

The nozzle hole 60 may be a through-hole provided in a cemented carbide, or a metal such as stainless steel, aluminum, and titanium.

Not only such metal-based materials but also ceramics or resin materials such as PEEK may be employed.

However, materials that are resistant to abrasion, erosion, and elution possibly caused by particle-containing liquid materials during discharging of the liquid materials may need to be selected.

Additionally, an inner diameter of the nozzle may be adjusted within a range from about 0.05 mm to about 0.5 mm, depending on a size of the discharged droplet.

A length of the nozzle may be adjusted within a range from about 0.05 mm to about 5 mm, depending on physical properties such as viscosity and thixotropy of liquid materials, surface tension, and a contact angle between the liquid material and a surface of the nozzle.

In FIG. 5, the supply flow channel 52 and the nozzle hole 60 are shown as a single structure for the sake of shorthand.

However, a nozzle hole 60 may be provided in a separate component for the sake of improving easiness of production and maintenance.

<Supply Flow Channel 52>

The supply flow channel 52 may be formed by using the same material as the materials described for the nozzle hole 60.

A cross-section of the supply flow channel 52 may be a circle with a diameter from about 0.5 mm to about 10 mm, or may be a rectangle with about the same area of cross section.

The cross-section of the supply flow channel 52 is preferably circular in terms of workability and prevention of formation of air bubbles.

The supply flow channel 52 makes it possible for a liquid-material-supply tank (not shown in figures) to communicate with the nozzle hole 60.

The supply flow channel 52 has a function to supply the liquid material stored in the tank to the nozzle hole 60.

<Plunger 12>

The plunger 12 moves through a guideway 110, and a pore of a seal material 104.

Accordingly, the liquid material is extruded from the nozzle hole 60 of the supply flow channel 52.

The plunger 12 may be formed of the same materials as the above-mentioned materials for forming the nozzle hole 60.

However, materials that are resistant to abrasion possibly caused by the guideway 110, the seal material 104, and particles included in the liquid material, and that are resistant against erosion, and elution caused by the liquid material may need to be selected for the plunger 12.

Moreover, to cause the plunger 12 to move at high speed, a material having a smaller specific weight is preferably selected.

Furthermore, the volume of the plunger 12 is preferably reduced to the minimum to lighten the plumber 12.

The plunger 12 has a function to convert a driving energy caused by the actuator 2 to an energy for discharging the liquid material.

When the plunger 12 is reciprocated in the vicinity of the nozzle hole 60, a pressure is applied to the liquid material in the vicinity of the nozzle hole 60, and thus, the discharge droplet 65 is caused to discharge from the nozzle hole 60.

The shape of the tip of the plunger 12 may be flat as shown in FIG. 5, or may be arranged as any one of protruding shapes shown in FIGS. 6A to 6F.

<Guideway 110>

The guideway 110 causes the plunger 12 to move straight in the vertical direction.

The guideway 110 has a through-hole, and the plunger 12 move up and down through the through-hole.

<Actuator 2>

The actuator 2 is used as a drive source that causes the plunger 12 to reciprocate. Motors, air pump, piezoelectric elements, etc. may be employed therefor.

<Displacement-Expanding Mechanism 3>

For the displacement-expanding mechanism 3, a material that can simultaneously realize sufficient abrasion resistance and lightweight properties is selected in the same manner as plunger 12. The displacement-expanding mechanism 3 includes a pivot point part 101 and a lever 102.

The displacement-expanding mechanism 3 has a function to expand the displacement of the plunger 12 larger than the displacement of the actuator 2.

When the plunger 12 is caused to reciprocate to a large extent by using a smaller actuator 2, it becomes possible to discharge high-viscosity liquid materials, and liquid materials including large particles, from the nozzle hole 60.

In FIG. 5, the lever 102 is located on the pivot point part 101 placed in contact with a housing 30, and thus, the plunger 12 is retained in contact with the tip of the lever 102 based on a tensile force of the elastic member 103.

Alternatively, the elastic member 103 may be placed between the plunger 12 and the housing 30, and thus, the plunger 12 may be retained based on the resulting compression force.

The elastic member 103 may be a coiled spring, or a flat spring.

A spring constant therefor is preferably selected within a range from about 0.1 N/mm to about 10 N/mm.

This is because, if the spring constant is excessively small, the natural frequency would be lower, and thus, high-speed operation would become impossible. On the other hand, if the spring constant is excessively large, the changes in the spring force caused due to displacements of the actuator would be significant, and thus, the operation may become unstable.

<Contact Parts Between the Lever 102 and the Actuator 2>

At least either of contact parts between the lever 102 and the actuator 2 is curved.

Accordingly, the actuator 2 is brought into contact with the top surface of the lever 102, and thus, can cause the displacement of the lever 102.

The lever 102 rotates around the pivot point part 101.

According to this rotation, the plunger 12 placed in the tip of the lever 102 can reciprocate upward and downward due to the displacement of the actuator 2.

Furthermore, in order to reduce sliding resistance between the contact parts of the lever 102 and the actuator 2, at least either of the contact surfaces may have an irregular shape. That is, recessions and projections may be present on either of the contact surfaces. Thus, the irregular shape is formed thereon.

<Contact Surfaces Between the Pivot Point Part 101 and the Lever 102>

The pivot point part 101 has a cylindrical shape.

The tip of the lever 102 has a convex curve, and is brought into contact with the point of load 109 in a flange plane surface of the plunger 12.

Furthermore, apart of the lever 102 that is brought into contact with the pivot point part 101 has a concave curve with a curvature radius equal to or larger than the curvature radius of the pivot point part 101.

These members may be formed as a single body.

Additionally, the convex curve and the concave curve may be located at opposite positions.

In this case, a center of the pivot point part 101, around which the lever 102 is rotated, is referred to as a pivot point 107, the contact surface of the lever 102 with the actuator 2 is referred to as the point of effort 108, and a point of the plunger 12 that the lever 102 presses is referred to as the point of load 109.

As illustrated in FIG. 5, the pivot point 107, the point of effort 108, and the point of load 109 are not located along the same line, and thus, forms a triangle.

In FIG. 5, the actuator 2 and the plunger 12 are located in the same direction with respect to the pivot point 107, which serves as a rotation center for the lever 102. However, the actuator 2 and the plunger 12 may be located in different directions.

It would be important that a distance L1 from the pivot point 107 to the point of effort 108 is made smaller than a distance L2 from the pivot point 107 to the point of load 109.

Accordingly, it becomes possible to expand the displacement of the plunger 12 larger than the displacement of the actuator 2

Additionally, when the actuator 2 is a piezoelectric element, it would be possible to apply a preliminary pressure of compression load by the elastic member 103 in order to prevent breakage of the piezoelectric element due to the tensile force.

As a result, it becomes possible to improve driving reliability of the actuator 2.

<Coating Operation>

Next, coating operation of liquid materials will be described below.

(I) Supply of Liquid Materials

When the tip of the plunger 12 moves upward inside the supply flow channel 52 to which a liquid material is loaded, the liquid material is supplied to the vicinity of the nozzle hole 60.

By applying a back pressure of about 0.1 kPa to about 500 kPa to a liquid-material-supply tank (not shown in figures) that is connected directly to the supply flow channel 52, the supply speed of the liquid material is increased, and thus, it becomes possible to apply a high-viscosity material at shorter discharge intervals.

The higher the back pressure is, the higher the supply speed of the liquid material is. However, when a particle-containing paste material is coated, a problem in which a solid content and a liquid content are separated from each other may arise, and therefore, the back pressure is preferably about 300 kPa or lower.

Additionally, even when the back pressure is adjusted to 300 kPa or lower, an air-liquid interface (meniscus surface) inside the nozzle hole 60 may become unstable, and thus, stable droplet-discharging may become impossible, if events in which the liquid material leaks from the nozzle hole 60 occur. Therefore, in that case, it would be critical to adjust the back pressure appropriately depending on a type of the liquid material, and discharging conditions.

(II) Discharge of Liquids

When the plunger 12 moves downward approaching the nozzle hole 60, a liquid pressure in the vicinity of the nozzle hole 60 rises, and thus, the discharge droplet 65 of the liquid material is discharged.

In that case, a seal material 104 is placed so as to adhere tightly to the plunger 12 and the housing 30, so that the liquid pressure in the vicinity of the nozzle hole 60 is not reduced even while the plunger 12 is moved upward and downward.

The higher the speed of the downward movement of the plunger 12 is, the more rapidly the nozzle pressure can be increased.

Accordingly, the discharge speed of the liquid material discharging from the nozzle hole 60 can be increased.

Furthermore, after the forehand liquid material starts to discharge from the nozzle hole 60, the discharge speed of the subsequent liquid material can rapidly be reduced by moving plunger 12 upward at high speed.

Accordingly, even when a high-viscosity liquid material is used, it becomes possible to reduce stringiness of the discharge droplet, and a more minute amount of discharge droplet 65 can stably be discharged.

In FIG. 5, the plunger 12 moves upward and downward while the tip of the plunger 12 is brought into contact with the liquid material inside the supply flow channel 52. However, as shown in FIG. 7, the tip of the plunger 12 may not be brought into direct contact with the liquid material, and a surface of a diaphragm 105 may be moved upward and downward.

Figure 7:
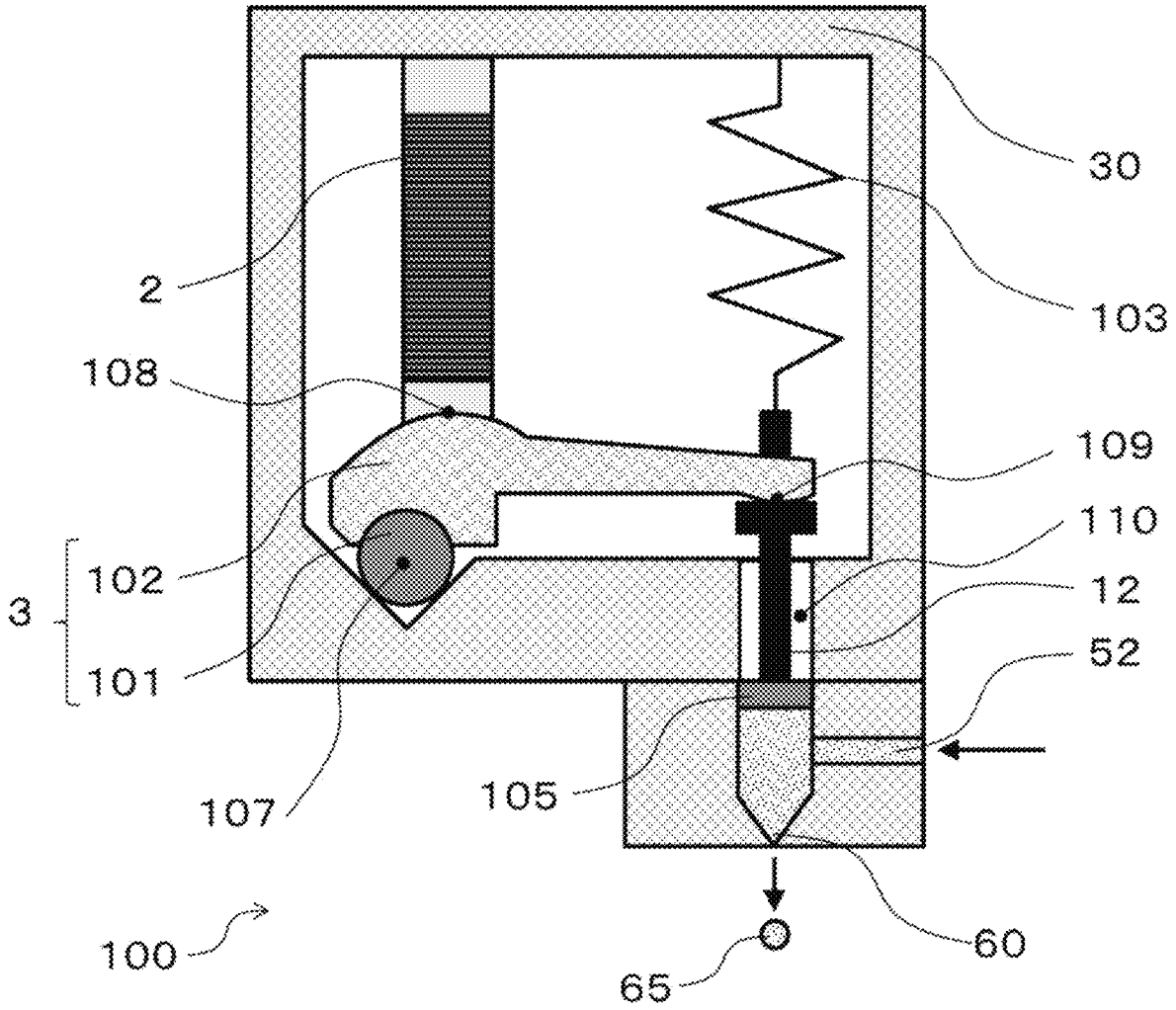
FIG. 7 is a cross-section view of a liquid-applying apparatus according to an embodiment.

FIG. 7 is a cross-section view of a variation of the liquid-applying apparatus 100 shown in FIG. 5.

The plunger 12 is located on the upper surface of the diaphragm 105.

The plunger 12 pushes and pulls the diaphragm 105.

<Variation 1 of the Displacement-Expanding Mechanism 3>

Hereinafter, a variation of the displacement-expanding mechanism 3 will be described below.

Figure 8A:
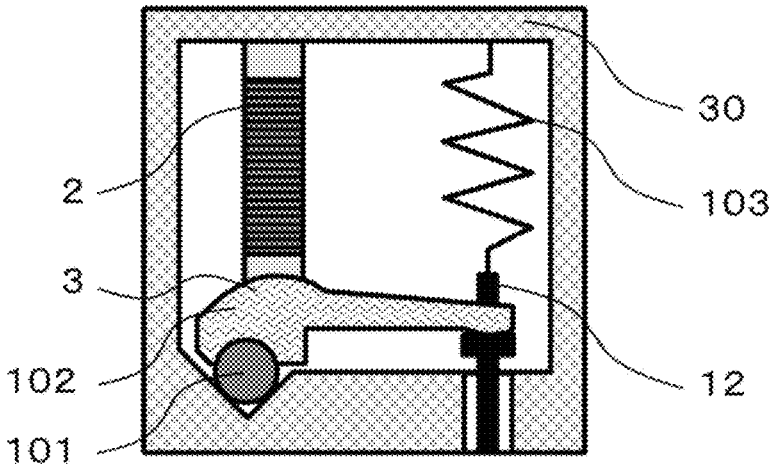
FIG. 8A is a cross-section view of a liquid-applying apparatus according to an embodiment.

FIG. 8A shows the same basic structure as the above-described liquid-applying apparatus 100.

The same basic structure is shown therein for the purpose of comparison.

Figure 8B:
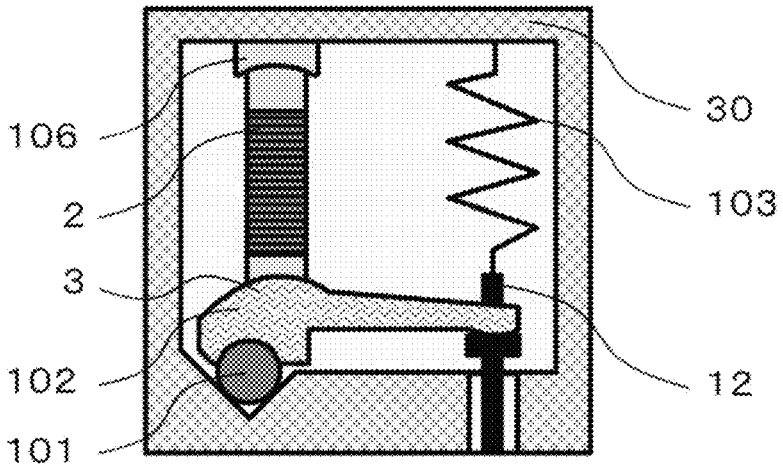
FIG. 8B is a cross-section view of a liquid-applying apparatus according to an embodiment.

As shown in FIG. 8B, a bearing 106 with a curved surface may be provided on a surface of the actuator 2, which is not brought into contact with the lever 102.

According to such a structure, a force in a short axis direction (horizontal direction in FIG. 8A) does not act on actuator 2, and thus, the drive reliability can be improved.

<Variation 2 of the Displacement-Expanding Mechanism 3>

Furthermore, in order to improve a displacement-response speed of the plunger 12 in the displacement-expanding mechanism 3, thereby securing sufficient long-term continuous-drive reliability, it is required that drive resistance in sliding parts of the actuator 2, the lever 102, pivot point part 101 and the plunger 12 be reduced.

Figure 8C:
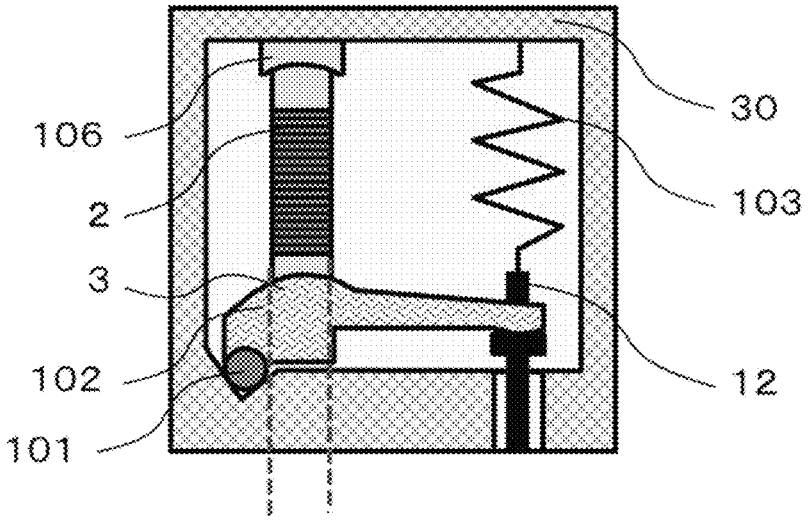
FIG. 8C is a cross-section view of a liquid-applying apparatus according to an embodiment.

Therefore, as shown in FIG. 8C, contact surfaces of the actuator 2 and the lever 102, and contact surfaces of the lever 102 and the pivot point part 101 may be arranged so as not to overlap with each other when viewed from the long-axis direction of the actuator 2. Accordingly, it becomes possible to reduce a reaction force that the lever 102 receives when it drives, and thus, it becomes possible to suppress excess sliding resistance.

In other words, contact surfaces of the lever 102 and the pivot point part 101 are arranged so as not to be present within an area shown by dotted lines in FIG. 8C.

Furthermore, by forming recessions and projections (irregularities), or grooves having sizes of about 0.1 μm or larger on either or both of the sliding surfaces, contact areas can be reduced, thereby simultaneously reducing the sliding resistance.

Additionally, in order to reduce the sliding resistance in the contact interface, solid lubricants or greases are preferably coated to form films thereon.

<Variation 3 of the Displacement-Expanding Mechanism 3>

Figure 9A:
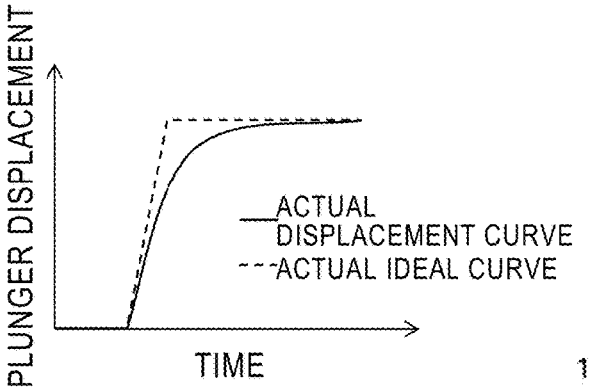
FIG. 9A is a diagram that shows displacement behaviors of a plunger in an embodiment.

FIG. 9A shows relations between displacements of the plunger 12 and the time.

Ideally, the plunger 12 should be displaced in accordance with the ideal curve.

However, the plunger 12 is displaced along the actual displacement curve because of time response lags.

Especially when a high-viscosity liquid material is caused to discharge, the plunger 12 is displaced along the actual displacement curve.

Such a phenomenon significantly occurs when a large displacement of the plunger 12 is caused, because the drive resistance of the plunger 12 becomes larger.

Main causes include the followings:

(i) as the tip of the plunger 12 come closer to the nozzle hole 60, a pressure in the vicinity of the nozzle hole 60 in the tip of the plunger 12 becomes higher;

(ii) as the displacement or the displacement-expanding factor of the actuator 2 becomes higher, the tensile force and compression force by the elastic member 103 become higher.

Figure 9B:
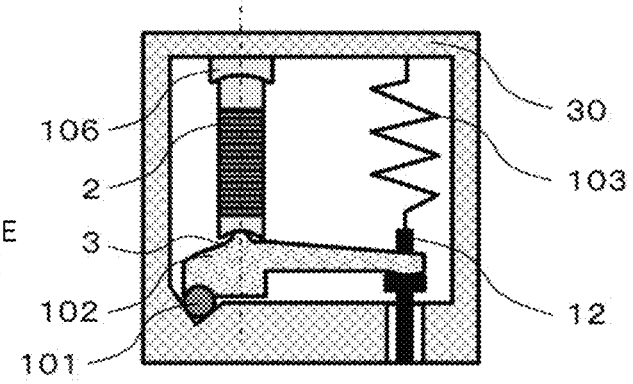
FIG. 9B is a cross-section view of a liquid-applying apparatus according to an embodiment.

As a countermeasure against the above, as shown in FIG. 9B, contact surfaces of the actuator 2 and the lever 102 are preferably formed by curves with different curvature radii.

FIG. 9B is a cross-section view of a variation of the liquid-applying apparatus 100.

With regards to contact surfaces of the actuator 2 and the lever 102, in cases in which the contact surface of the lever 102 is formed as a convex curve, the contact surface of the lever 102 is preferably configured so as to have a curvature radius smaller than the curvature radius of the contact surface of the actuator 2.

On the other hand, in cases in which the contact surface of the lever 102 is configured as a concave curve, the contact surface of the lever 102 is preferably configured to have a curvature radius larger than the curvature radius of the contact surface of the actuator 2.

Figure 9C:
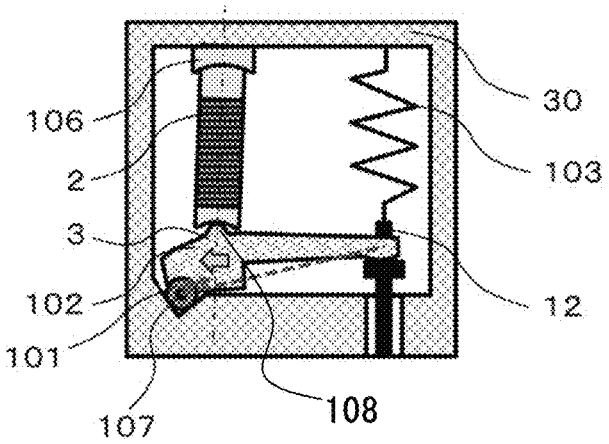
FIG. 9C is a cross-section view of a liquid-applying apparatus according to an embodiment.

FIG. 9C is a cross-section view of a variation of the liquid-applying apparatus 100. FIG. 9C illustrates a cross-section of the liquid-applying apparatus 100 when the plunger 12 starts downward movement.

Figure 9D:
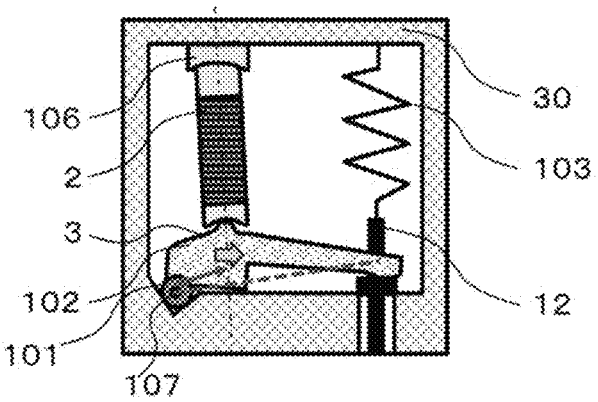
FIG. 9D is a cross-section view of a liquid-applying apparatus according to an embodiment.

FIG. 9D is a cross-section view of the variation of the liquid-applying apparatus 100. FIG. 9D illustrates a cross-section of the liquid-applying apparatus 100 when the plunger 12 completes downward movement.

As shown in FIG. 9C, when the plunger 12 starts the downward movement, a distance (shown by an arrow) between the point of effort, where the actuator 2 pushes the lever 102, and the pivot point 107 becomes comparatively shorter, and thus, expansion of the displacement becomes larger. Accordingly, it becomes possible to accelerate the initial rise in the displacement response.

Furthermore, as shown in FIG. 9D, when the plunger 12 completes the downward movement, a distance (shown by an arrow) between the point of effort, where the actuator 2 pushes the lever 102, and the pivot point 107 becomes comparatively longer, and thus, expansion of the displacement becomes smaller. Accordingly, it becomes possible to realize a higher force of push load of the plunger 12, and thus, it becomes possible to accelerate the displacement response without succumbing to the drive resistance of the plunger 12.

In that case, when the plunger 12 moves downward, the length of the arrow is varied, and thus, it becomes possible to gradually reduce the displacement-expansion factor of the displacement-expanding mechanism 3.

<Variation 4 of the Displacement-Expanding Mechanism 3>

Furthermore, in order to realize discharge of minute amounts of high-viscosity liquid materials, it would be critical that the plunger 12 is driven at high speed at comparatively smaller displacements based on larger forces.

For this purpose, it is required that the displacement-expansion factor of the displacement-expanding mechanism 3 is minimized to reduce the mass of the lever 102 for weight saving.

However, the actuator 2 and the elastic member 103 need to be configured such that they do not interfere with each other, and therefore, their design ranges would be restricted.

The same shall apply to cases in which the elastic member 103 is provided between the plunger 12 and the housing 30 while it is retained therebetween based on the compression force.

Figure 10:
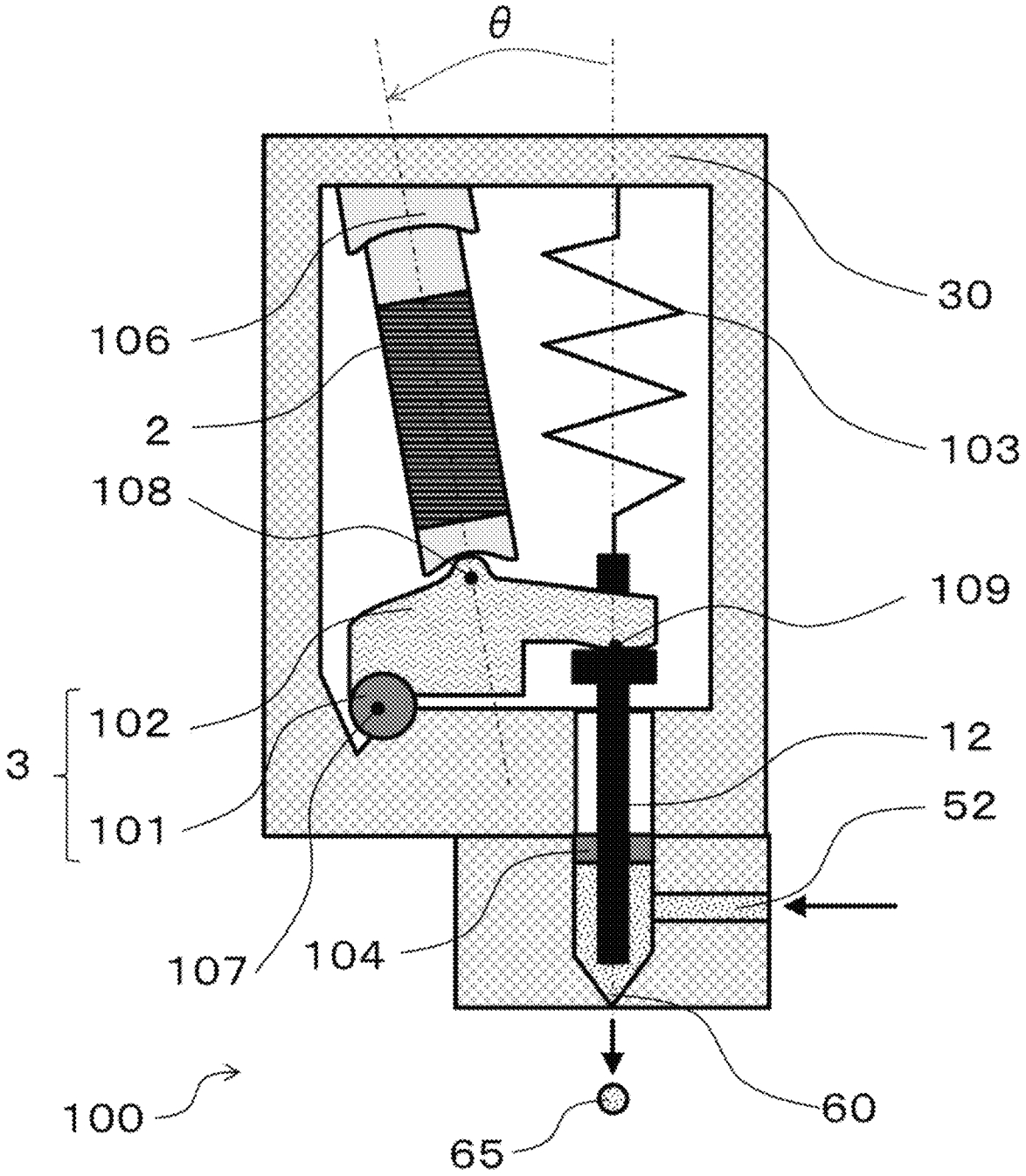
FIG. 10 is a cross-section view of a variation of the liquid-applying apparatus according to an embodiment.

As an embodiment serving as a countermeasure against the above problem, FIG. 10 shows a cross-section view of a variation of the liquid-applying apparatus 100.

As shown in FIG. 10, the liquid-applying apparatus 100 is configured such that there is an inclination angle θ of the displacement direction of the actuator 2 against the displacement direction of the plunger 12.

The inclination angle θ may be selected typically within a range from about one degree to about 90 degrees. When the inclination angle θ is selected within a range from about 10 degrees to about 60 degrees, the most effective countermeasure would be realized.

Additionally, FIG. 10 shows a state before the plunger 12 starts to move.

At the moment when the plunger 12 starts movement, the displacement direction of the actuator 2 is inclined against the displacement direction of the plunger 12.

By adopting the above-described configuration, it becomes possible to set a distance between the pivot point 107 and the point of effort 108 in a direction perpendicular to the displacement direction of the actuator 2 within a smaller range, while contact surfaces of the actuator 2 and the lever 102, and the contact surfaces of the lever 102 and the pivot point part 101 are configured so as not to overlap with each other when viewed from the long-axis direction of the actuator 2.

In addition, since a physical distance between the actuator 2 and the elastic member 103 becomes longer, the length of the lever 102 can be reduced.

Accordingly, the weight of the lever 102 can be reduced, and thus, inertia moments of moving elements such as the lever 102 and the plunger 12 can be reduced by about 50% to about 90%.

Since the acceleration rates are inversely proportional to the inertia moments when predetermined amounts of torque are applied thereto, it becomes possible to increase the displacement acceleration rate of the plunger 12 about 2 times to about 10 times, and this is effective for discharging minute amounts of high-viscosity liquid materials.

Additionally, in FIG. 10, although the actuator 2 and the plunger 12 are located in the same direction with respect to the pivot point, which is a rotation center of the lever 102, the actuator 2 and the plunger 12 may be located in different directions.

Liquid-applying apparatuses according to the embodiments make it possible to realize high-speed and stable control of coating of functional-particle-containing liquid materials.

Furthermore, liquid-applying apparatuses according to the above embodiments make it possible to realize high-speed coating of optimum amounts of liquid materials onto target spots at any given patterns in non-contact fashions.

Liquid-applying apparatuses according to the above embodiments can be employed for industrial purposes such as electronic-device production processes that require long-term continuous operations of liquid-applying apparatuses. Furthermore, liquid-applying apparatuses according to the above embodiments can preferably be employed for purposes of three-dimensional coating of liquid materials onto irregular or curved surfaces of three-dimensional structures, or for purposed of production of various types but small quantities of electronic devices, since the liquid-applying apparatuses have displacement-expanding mechanisms that make it possible to realize coating of liquid materials at any given patterns.

What is claimed is:

1. A liquid-coating apparatus, comprising:

(a) a nozzle hole from which a liquid material is to be discharged;

(b) a supply flow channel configured to supply the liquid material to the nozzle hole;

(c) a plunger configured to reciprocate in contact with the liquid material inside the supply flow channel;

(d) a displacement-expansion mechanism configured to displace the plunger; and (e) an actuator configured to displace the displacement-expansion mechanism, wherein:

the displacement-expansion mechanism includes a lever and a pivot point part supporting the lever;

each of a first contact part of the lever and a corresponding contact part of the actuator has a curved surface;

each of a second contact part of the lever and a corresponding contact part of the pivot point part has a curved surface;

a curvature of the first contact part of the lever is smaller than a curvature of the corresponding contact part of the actuator;

a curvature of the second contact part of the lever and a curvature of the corresponding contact part of the pivot point part are the same;

the displacement-expansion mechanism is at a first end of the actuator;

a bearing is at a second end of the actuator opposite to the first end of the actuator;

a curvature of the bearing and a curvature of a corresponding contact portion of the second end of the actuator are the same;

the liquid-coating apparatus is configured to change a distance between a pivot point of the pivot point part and a longitudinal axis of the actuator including a point of effort;

the pivot point of the pivot point part is a rotation center of the lever; and the point of effort is a contact point between the lever and the actuator.

2. The liquid-coating apparatus according to claim 1, further comprising an elastic member that is connected to the plunger.

3. The liquid-coating apparatus according to claim 1, wherein:

a point of load is a contact point between the lever and the plunger; and the pivot point, the point of effort and the point of load are noncollinear.

4. The liquid-coating apparatus according to claim 1, wherein at least one of the first contact part of the lever, the second contact part of the lever, the corresponding contact part of the actuator, and the corresponding contact part of the pivot point part has at least one of a recession, a projection and a groove defined therein.

5. The liquid-coating apparatus according to claim 1, wherein the liquid-coating apparatus is configured to vary a position of a contact point between the displacement-expansion mechanism and the actuator with movement positions of the plunger.

6. The liquid-coating apparatus according to claim 1, wherein there is an inclination angle between a displacement direction of the plunger and a displacement direction of the actuator.

7. The liquid-coating apparatus according to claim 1, wherein the actuator is a piezoelectric element.

* * * * *